US007331735B2

(12) United States Patent
McKenzie

(10) Patent No.: US 7,331,735 B2
(45) Date of Patent: Feb. 19, 2008

(54) APPARATUS, SYSTEM, AND METHOD FOR SUPPORTING A GATE ENTRY FOR UNDERGROUND FULL EXTRACTION MINING

(76) Inventor: Jefferson D. McKenzie, 4573 Nancy Dr., West Valley City, UT (US) 84120

( * ) Notice: Subject to any disclaimer, the term of this patent is extended or adjusted under 35 U.S.C. 154(b) by 0 days.

(21) Appl. No.: 11/266,550

(22) Filed: Nov. 3, 2005

(65) Prior Publication Data

US 2006/0158017 A1 Jul. 20, 2006

Related U.S. Application Data

(60) Provisional application No. 60/624,838, filed on Nov. 3, 2004.

(51) Int. Cl.
*E21D 23/03* (2006.01)

(52) U.S. Cl. ..... 405/1.7; 405/291; 405/296

(58) Field of Classification Search ..... 299/10, 299/11, 95, 31, 1.7; 405/291, 296, 299, 300, 405/302

See application file for complete search history.

(56) References Cited

U.S. PATENT DOCUMENTS

| | | | | |
|---|---|---|---|---|
| 1,594,475 A | * | 8/1926 | Smith | 405/290 |
| 3,447,328 A | * | 6/1969 | Schuermann | 405/291 |
| 3,999,804 A | | 12/1976 | Simpson | |
| 4,102,550 A | | 7/1978 | Campbell | |
| 4,190,385 A | | 2/1980 | Childress | |

(Continued)

FOREIGN PATENT DOCUMENTS

| | | | |
|---|---|---|---|
| DE | 3201387 A1 | * | 7/1983 |
| GB | 2077830 A | * | 12/1981 |
| GB | 2089411 A | * | 6/1982 |
| GB | 2185515 A | * | 7/1987 |

OTHER PUBLICATIONS

"A Decade of Mobile Roof Support Application in the United States", Larry Howe, Product Manager of Mobile Roof Supports of J.H. Fletcher & Co., Huntington, WV. Presented at the 17th Conference of Ground Control in Mining.

(Continued)

*Primary Examiner*—John Kreck
(74) *Attorney, Agent, or Firm*—Kunzler & McKenzie

(57) ABSTRACT

An apparatus, system, and method are disclosed for supporting a gate entry or a connecting entry. The apparatus includes a support member, a controller, and a vehicle. The support member is configured to selectively engage a mine roof and a mine floor within a gate entry. The controller communicates with the support member to extend the support member to engage the mine roof and mine floor and retract the support member to disengage the mine roof and mine floor. The vehicle is connected to the support member and controller and moves the support member in response to a motive force. The support member, controller, and vehicle can operate and move independent of a mining face conveyor. The present invention is reusable, provides for mine roof and mine floor support as well as support of gate entry walls. The present invention has a minimal width profile to provide support while minimizing interference with the airflow within the gate entry. In addition, the present invention forms an access passage for personnel, equipment, and airflow that remains safely open during full extraction mining operations even as load abutments shift due to full extraction mining.

17 Claims, 12 Drawing Sheets

U.S. PATENT DOCUMENTS

| | | | | | |
|---|---|---|---|---|---|
| 4,378,132 | A | | 3/1983 | Spies | |
| 4,416,566 | A | * | 11/1983 | Szebenyi et al. | 405/291 |
| 4,505,517 | A | * | 3/1985 | Seddon et al. | 299/31 |
| 4,566,587 | A | | 1/1986 | Gorlov | |
| 4,595,316 | A | | 6/1986 | Tinnel | |
| 4,753,484 | A | | 6/1988 | Stolarczyk | |
| 5,015,125 | A | | 5/1991 | Seegmiller | |
| 5,020,860 | A | | 6/1991 | Bessinger | |
| 5,165,824 | A | | 11/1992 | Corcoran | |
| 5,199,825 | A | | 4/1993 | Travis | |
| 5,219,208 | A | | 6/1993 | Liao | |
| 5,277,520 | A | | 1/1994 | Travis | |
| 5,308,196 | A | | 5/1994 | Fredrick | |
| 5,368,369 | A | * | 11/1994 | Maity et al. | 299/11 |
| 5,385,433 | A | | 1/1995 | Calandra, Jr. | |
| 5,417,521 | A | | 5/1995 | Scott | |
| 5,425,601 | A | | 6/1995 | Calandra, Jr. | |
| 5,542,788 | A | | 8/1996 | Stankus | |
| 5,564,866 | A | | 10/1996 | Snyder | |
| 5,782,539 | A | | 7/1998 | Peterson | |
| 6,109,700 | A | | 8/2000 | Branson | |
| 6,796,616 | B2 | | 9/2004 | Harman | |
| 6,857,705 | B2 | | 2/2005 | Hainsworth | |

OTHER PUBLICATIONS

J.H. Fletcher & Co. "Underground Mining Equipment", Mobile Roof Supports, Web page: http://jhfletcher.com/coalmrs.htm.

J.H. Fletcher & Co. "Mobile Roof Supports For Coal Pillar Extraction", Mobile Proof Supports, web page : http://jhfletcher.com/DDOBROCHURE/MRSrev.pdf, all undated.

" Preventing Longwall Tailgate Blockages", Center for Disease Control, National Institute for Occupational Safety and health [online] Apr. 5, 2007 http://0-www.cdc.gov.mill1.sjlibrary.org/niosh/nas/mining/intermediateoutcome22.htm.

Barczak, T.M. "An Overview of Standing Roof Support Practices and Developments in the United States", Center for Disease Control, National Institute for Occupational Safety and Health, [online] Apr. 5, 2007 http://0-www.cdc.gov.mill1.sjlibrary.org/niosh/mining/pubs/pdf/aoosr.pdf.

"Abutment Pressures", Wollongong University, Mining Engineering, [online] Apr. 11, 2007 http://www.uow.edu.au/eng/longwall/abutment.htm.

* cited by examiner

102/104

102/104

APPARATUS, SYSTEM, AND METHOD FOR SUPPORTING A GATE ENTRY FOR UNDERGROUND FULL EXTRACTION MINING

CROSS-REFERENCES TO RELATED APPLICATIONS

This application claims benefit of U.S. Provisional Patent Application No. 60/624,838 entitled "Apparatus, system, and method for longwall mining" and filed on Nov. 3, 2004 for Jefferson D. McKenzie, which is incorporated herein by reference.

BACKGROUND OF THE INVENTION

1. Field of the Invention

This invention relates to full extraction underground mining and more particularly relates to supporting gate entries and/or connecting openings during longwall or shortwall mining operations.

2. Description of the Related Art

The mining of minerals is a large industry with constantly developing technologies that improve the safety and efficiency of the mining operations. Technology is constantly being applied in the industry to reduce manpower, equipment needs, and costs.

In particular, underground mining carries constant risks to those who work underground. Of primary concern is the safety of the people working underground. Corporate interests and government regulations constantly monitor and evaluate the working conditions to ensure the utmost safety. Underground mining includes different types of full extraction mining. Full extraction mining is generally underground mining in which substantially all of the mined mineral is removed from the mine. Examples of full extraction mining include pillar mining, shortwall mining, longwall mining and the like. Examples of minerals that may be mined using full extraction mining include coal, potash, trona, salt, and the like. Although longwall mining is referenced herein as one example of full extraction mining those of skill in the art will recognize that embodiments of the present invention may be used in of various other types of full extraction mining.

Full extraction mining such as longwall mining may be conducted using an advancing method or a retreating method. In longwall retreat mining, a pair of tunnels are mined parallel to each other on each side of a mineral seam. These tunnels are generally referred to as gate entries, as longwall (or shortwall) entries, gate roads, or simply gates referred to herein as "a gate entry" or "gate entries." The gate entries serve as the life line to the surface. The gate entries provide access for equipment and personnel, provide fresh air from the surface, provide two escape routes in case problems arise.

Keeping the gate entries open and safe is required for safe and efficient full extraction mining. Roof failure in gate entries is a major safety concern. Thousands of accidents occur each year due to roof failures. Roof supports are to protect the miners, but these supports can fail as well.

Due to the dangers involved, government regulations or corporate policies generally regulate how the gate entries are engineered, formed, and maintained as well as the technology and equipment used to support and keep the gate entries open and unobstructed. As full extraction mining is conducted, gate entries are susceptible to cave in of the roof and/or movement of the floor or walls which is collectively referred to herein as gate entry failure. Changes in the composition of the mineral or rock forming the roof, walls, or floor of the gate entry can also contribute to gate entry failures.

Conventional support systems for gate entries include installing and anchoring steel rods (roof, wall, or floor bolts), installing and anchoring steel cables (roof, rib, or floor cables), installing wooden or metal posts or cylinders against the floor and roof, applying glue or grout, installing concrete pillars and wedges, and/or installing steel beams or arches. These conventional support systems are installed throughout gate entries at great expense. All the materials used to support gate entries must be transported from the surface down to the gate entry within the mine. For example, the labor and material transportation costs can result in up to about $1,000 per foot. Furthermore the materials are typically very expensive. Adding to the cost of the materials, the conventional support systems are not removed once full extraction mining is complete due to the dangers to the workers.

In addition, certain conventional gate entry support systems are passive, meaning the support systems does not support a load until the gate entry roof or floor breaks apart and begins to fail. Furthermore, the passive gate entry support systems are installed and set manually by workers which increases the expense and time required to prepare the gate entry. Conventional support mechanisms provide only a limited support capacity. Often the support mechanisms must be replaced or reinforced repeatedly to provide adequate support. These support mechanisms can be very costly and, at times, ineffective at maintaining necessary safe access to the mining area.

One conventional support system includes a roof support integrated with a mining face conveyor. The mining face conveyor is a conveyor that carries a mineral away from a mining face. Consequently, the conventional support system is restricted to use within the mining face. Because the conventional support system is coupled to the mining face conveyor, the conventional support system is not capable of supporting a mine roof or floor within a gate entry independent of the mining face. Instead, the conventional support system ensures that the mining face conveyor remains in proper alignment with a transfer conveyor or stage loader. Unfortunately, this means that the conventional support system cannot be used independent of the mining face conveyor and/or a mineral transport conveyor. Furthermore, the conventional support system is unable to provide any support in gate entries that do not include the mineral transport conveyor and/or mining face conveyor. Finally, conventional support systems fail to provide support and facilitate airflow within gate entries.

From the foregoing discussion, it should be apparent that a need exists for an apparatus, system, and method for supporting a gate entry for underground full extraction mining. Beneficially, such an apparatus, system, and method would be reusable, operate independent of a mining face conveyor, provide for both mine roof, mine walls, and mine floor support. Advantageously, such an apparatus, system, and method would provide for selective lateral support of gate entry walls. Such an apparatus, system, and method would also be mobile and comprise a minimal width profile to provide support while minimizing interference with the airflow within the gate entry. In addition, the apparatus, system, and method would form an access passage for personnel, equipment, and airflow that remains safely open during full extraction mining operations even as load abutments shift due to full extraction mining.

SUMMARY OF THE INVENTION

The present invention has been developed in response to the present state of the art, and in particular, in response to the problems and needs in the art that have not yet been fully solved by currently available gate entry roof supports. Accordingly, the present invention has been developed to provide an apparatus, system, and method for supporting a gate entry for underground full extraction mining that overcome many or all of the above-discussed shortcomings in the art.

The apparatus to support a gate entry for underground full extraction mining includes a support member configured to selectively engage a mine roof and a mine floor within a gate entry. The apparatus also includes a controller in communication with the support member, the controller configured to extend the support member to engage the mine roof and mine floor and retract the support member to disengage the mine roof and mine floor. The apparatus also includes a vehicle connected to the support member and controller, the vehicle configured to move the support member in response to a motive force acting on the vehicle. Preferably, the support member, controller, and vehicle are independent of a mining face conveyor. In other words, the support member, controller, and vehicle are not constrained by or physically coupled to the mining face conveyor.

The apparatus comprises a streamlined profile that maximizes airflow past the apparatus. In certain embodiments, the streamlined profile maximizes airflow past the apparatus provided the apparatus is positioned parallel to the length of a gate entry or connecting entry within which the apparatus is positioned. The apparatus may also include a lateral extension member configured to extend and retract laterally to selectively engage one or more walls of the gate entry in response to a control signal. In certain embodiments, the support member is configured to passively or actively engage one or the mine roof and/or mine floor. Similarly, the lateral extension member may be configured to passively or actively engage one or both walls of a gate entry or connecting entry. Passive engagement means that the support member or lateral extension member does not apply a positive support force. Active engagement applies a positive support force.

A system of the present invention is also presented for supporting a gate entry for underground full extraction mining. The system includes a hydraulic support member configured to selectively engage a mine roof and a mine floor within a gate entry. The system also includes a controller in electrical communication with the hydraulic support member, the controller configured to extend the hydraulic support member to engage the mine roof and mine floor and retract the hydraulic support member to disengage the mine roof and mine floor. Finally, the system includes a stage loader positioned within the gate entry and coupled to the hydraulic support member, the stage loader configured to move the hydraulic support member in response to advancement of longwall face end supports during an extraction mining operation.

In certain embodiments, the system includes a lateral extension member configured to extend and retract laterally to selectively engage one or both walls of the gate entry in response to a control signal. Preferably, the hydraulic support member and controller of the system are mechanically configured to maximize airflow past the hydraulic support member and controller. The hydraulic support member of the system may comprise a shield support, a chock support, a chock shield support, or a mobile roof support.

A method is also presented for supporting a gate entry for underground full extraction mining. The method in the disclosed embodiments substantially includes the steps necessary to carry out the functions presented above with respect to the operation of the described apparatus and system. In one embodiment, the method includes positioning one or more movable support apparatus within a gate entry to form an access passage between opposing gate entry walls, the movable support apparatus comprises the apparatus described above. Next, full extraction mining operations are conducted such that loading forces acting on the gate entry change during full extraction mining operations. Next, the movable support apparatus are re-positioned within the gate entry in response to commands from the controller such that the access passage remains substantially unblocked during full extraction mining operations. The method may also include positioning the movable support apparatus such that the movable support apparatus operates independent of a longwall face conveyor. The method may also include extending a lateral extension member to engage one or both walls of the gate entry in response to a control signal from the controller.

Reference throughout this specification to features, advantages, or similar language does not imply that all of the features and advantages that may be realized with the present invention should be, or are in, any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

The described features, structures, or characteristics may be combined in any suitable manner in one or more embodiments. In the following description, numerous specific details are provided, such as examples of materials, fasteners, sizes, lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of various structural components, motors, hoses, cabling, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
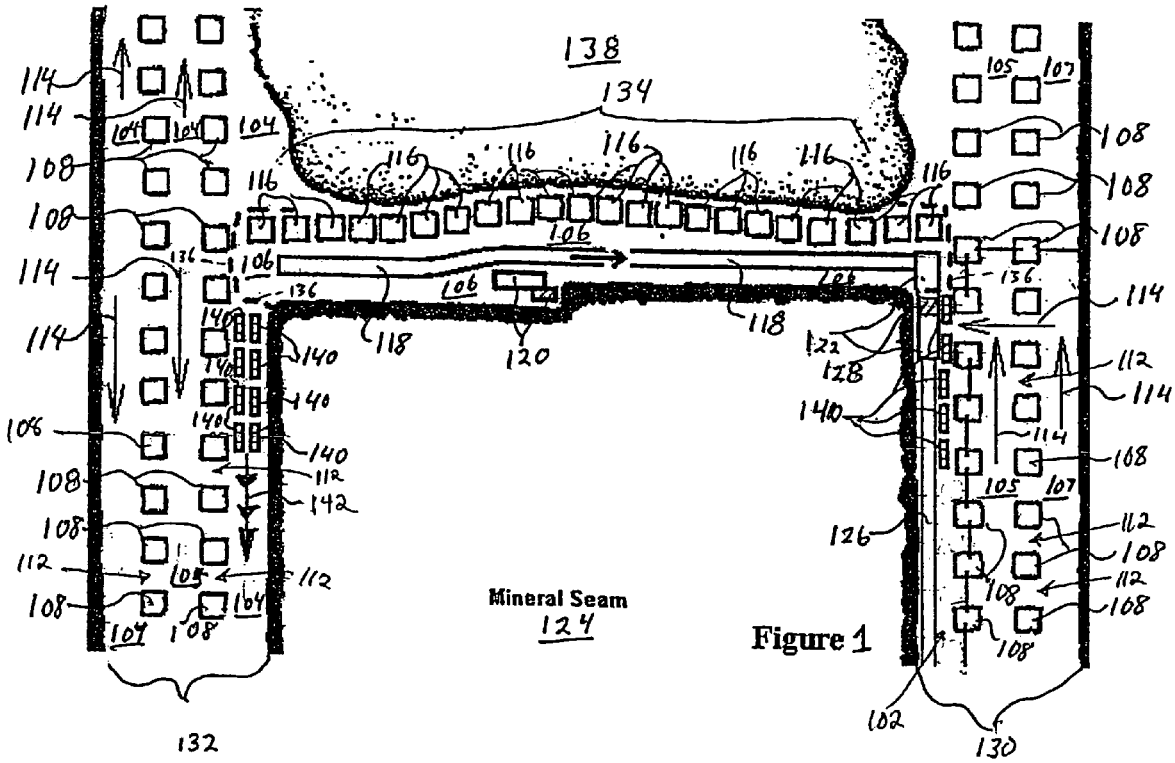
FIG. 1 is a schematic block diagram illustrating one embodiment of a mine design that utilizes an apparatus for supporting one or more gate entries for underground full extraction mining in accordance with the present invention.

FIG. 1 illustrates a system 100 for full extraction mining that includes one or more apparatuses for supporting gate entries for underground full extraction mining. The system 100 includes a pair of gate entries 102, 104 and a mining face 106. Gate entries 102, 104 serve as access passages to the mining face 106. The gate entries 102, 104 are used to bring in and remove equipment, personnel, and fresh air to the mining face 106.

Typically, gate entries 102, 104 are about 20 feet wide and can be very long. The gate entries 102, 104 connect either directly or indirectly to the surface of the mine. The gate entries 102, 104 may include a plurality of pillars 108 that serve as one wall of the gate entry 102, 104. The pillars 108 may comprise the original rock or mineral or may be man made using timbers, or concrete. Cross-cuts 112 (also known as connecting entries 112) are between pillars 108. The cross-cuts 112 and pillars 108 are designed to provide a maximum size gate entries 102, 104 with redundant paths to escape should parts of the gate entry 102, 104 cave in or become sealed off.

Typically, a plurality of parallel gate entries 102, 105, 107 are cut in preparation for full extraction mining. The additional gate entries 105, 107 typically do not include the current mineral seam 124 that is to be mined. Instead, these additional gate entries 105, 107 may provide additional access or escape routes. In addition, the additional gate entries 105, 107 may facilitate movement of material, equipment, and personnel to a subsequent mineral seam for additional mining operations. As described herein, the gate entries 102, 104 that include the mineral seam 124 as one wall are discussed in great detail. However, those of skill in the art will recognize that the present invention can also be used in the one or more additional gate entries 105, 107.

The size of the gate entries 102, 104 also facilitates airflow and air circulation along the mining face 106. Large fans at the surface move high quantities of fresh air into the mine. Preferably, the airflow of fresh air (indicated by arrows 114) enters one gate entry 102 and flows across the mining face 106 and exits by way of the other gate entry 104. Air may also travel within the additional gate entries 105, 107. Adequate air circulation provides fresh air for the workers, reduces mineral dust created by mining of the mineral, helps to keep the equipment cooled, and removes any dangerous gases found in the mine.

The mining face 106, also referred to as a longwall face 106 in longwall mining operations, is an area of the mine where the mineral is being cut up and removed from the mine. In longwall mining, the mining face 106 includes a plurality of mobile roof supports 116, a mining face conveyor 118, a cutter 120 or shearer 120, and a stage loader 122.

Those of skill in the art will readily recognize the equipment used on the mining face 106 to conduct underground full extraction mining operations. Consequently, the description here will be limited to providing adequate context for the present invention. Mobile roof supports 116 are a plurality of supports that hold up the roof within the mining face 106 while the mineral is being cut and loaded onto the mining face conveyor 118. The mining face conveyor 118 is a conveyor belt system that collects mineral cut from the mineral seam 124 and moves the mineral to one end of the mining face 106. The shearer 120 moves side to side along the exposed portion of the mineral seam 124 and cuts mineral from the mineral seam 124.

Typically, the mobile roof supports 116 are aligned parallel to a mineral seam 124. The mining face conveyor 118 and the shearer 120 abut the exposed surface of the mineral seam 124. The shearer 120 moves side to side along the exposed portion of the mineral seam 124 and cuts mineral from the mineral seam 124. The cut mineral falls onto the mining face conveyor 118 which moves the mineral to one end of the mining face 106. The mining face conveyor 118 delivers the mineral to the stage loader 122.

The stage loader 122 receives the mineral and prepares the mineral for transport to the surface. The stage loader 122 deposits the mineral onto a transport conveyor 126 which moves the mineral to the surface or another storage location using one or more conveyors. Typically, a stage loader 122 facilitates movement of the mineral around the corner from the mining face 106 to the gate entry 102. The stage loader 122 may include a crusher 128. The crusher 128 breaks the mineral into a consistent size to facilitate transport of the mineral to the surface.

Typically, the gate entry 102 and one or more additional gate entries 105, 107 collectively form the headgate 130. The headgate 130 includes the stage loader 122 and transport conveyor 126. Of course the headgate 130 may include more that two additional gate entries 105, 107. The gate entry 104 and one or more additional gate entries 105, 107 collectively form the tailgate 132. The tailgate 132 is typically a collection of parallel gate entries 104, 105, 107 that do not house the stage loader 122 and transport conveyor 126.

Once the shearer 120 makes one or more passes across the mining face 106, the mining face conveyor 118 and shearer 120 advance to once again abut the exposed surface of the mineral seam 124. The stage loader 122 is also advanced toward the gate entry 102. The mining face conveyor 118 preferably uses the mobile roof supports 116 as anchors to push against. Once the mining face conveyor 118, shearer 120, and stage loader 122 are in place, the mobile roof supports 116 cooperate to advance towards the mining face conveyor 118. Collectively, the equipment within the mining face 106 may be referred to as a long wall 134. As the longwall 134 advances the roof above the mining face 106 is allowed to collapse behind the mobile roof supports 116.

The mining system 100 of FIG. 1 illustrates a mining technique known as retreat mining. In retreat mining, the gate entries 102, 104 are formed first along the mineral seam 124. The longwall 134 is installed within the mining face 106. The longwall 134 then advances into the mineral seam 124 and as the longwall 134 advances the gate entries 102, 104 shorten and transition (indicated by dashed line 136) from gate entries 102, 104 to mining face 106 and to a gob area 138 where the mobile roof supports 116 have allowed the mine roof to cave in. Consequently, the gate entries 102, 104 retreat from an original length to a shorter length as full extraction mining is performed.

As the longwall 134 advances, the ground pressures above the mine change as well. These transferred ground pressures are known as pressure abutments and advance with the longwall face 106 as the longwall face 106 advances during recovery (mining) of the mineral. These pressure abutments can cause the mine roof and/or mine floor within the gate entries 102, 104 to fail (cave in or up heave). Such failures can severely restrict the flow of materials, personnel, and air to the mining face 106. Catastrophic failures can close off one gate entry 102, 104 and in some cases both gate entries 102, 104.

Consequently, the present mining system 100 includes one or more moveable support apparatuses 140. Preferably, the moveable support apparatuses 140 are placed strategically within one or more gate entries 102, 104. The moveable support apparatuses 140 preferably extend vertically to support both the mine roof and the mine floor within a gate entry 102, 104. In addition, or alternatively, the moveable support apparatuses 140 may extend a support laterally to support one or both walls of a gate entry 102, 104. Preferably, the moveable support apparatuses 140 are configured such that minimal airflow is impeded flowing between the gate entry 102, 104 and the mining face 106. Advantageously, the moveable support apparatuses 140 may be retracted and moved forward (see arrow 142) within a gate entry 102, 104 to provide support as pressure abutments move forward during full extraction mining. Preferably, the moveable support apparatuses 140 are not physically connected to the longwall 134. In other words, there is no direct connection between a moveable support apparatus 140 and the mining face conveyor 118. This independence permits moveable support apparatuses 140 to be positioned well ahead of the longwall 134 to prevent any mine floor or mine roof failures due to the advancing pressure abutments.

Use of moveable support apparatuses 140 saves time and expense because less time is required to properly position and install each moveable support apparatus 140. In addition, because the moveable support apparatuses 140 moves with the longwall 134 the moveable support apparatuses 140 are not left behind as with other conventional passive gate entry support systems.

The moveable support apparatuses 140 are also capable of higher load support capacities than conventional support systems. Preferably, the moveable support apparatuses 140 are capable of each supporting between about 100 tons and about 2000 tons. Preferably, the moveable support apparatuses 140 are positioned parallel to the gate entry 102, 104 such that minimal airflow and gate entry width is obstructed by the moveable support apparatuses 140. Preferably, the moveable support apparatuses 140 have a width of up to about 5 feet. In this manner, one or more moveable support apparatuses 140 may be positioned along side a stage loader 122 or transport conveyor 126 without adversely impeding the airflow. The minimal width of the moveable support apparatuses 140 also allows workers to easily pass by the moveable support apparatuses 140 to access the mining face 106.

Figure 2:
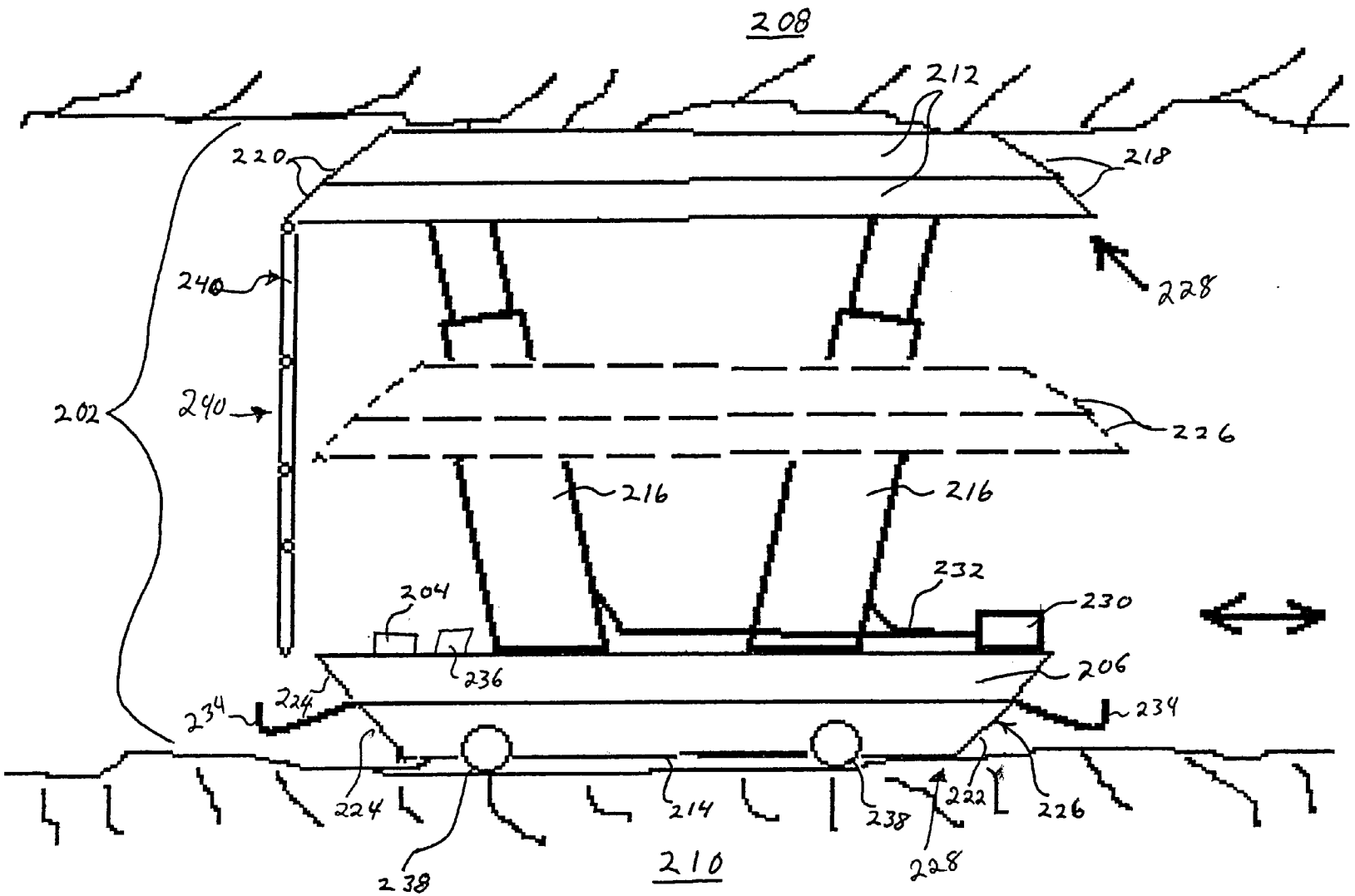
FIG. 2 is a side view illustrating one embodiment of an apparatus for supporting a gate entry for underground full extraction mining.

FIG. 2 illustrates a side view of one embodiment of an apparatus 200 for supporting a gate entry 102, 104 for underground full extraction mining. The apparatus 200 includes a support member 202, a controller 204, and a vehicle 206. The support member 202 is configured to selectively engage a mine roof 208 and a mine floor 210 within a gate entry 102, 104.

The support member 202 supports a pressure load from the mine roof 208 or mine floor 210 as full extraction mining operations are conducted. Preferably, the pressure which the support member 202 exerts can be adjusted by the controller 204. In this manner a support member 202 may engage the mine roof 208 and mine floor 210 with minimal pressure and serve as a passive gate entry support. Alternatively, the support member 202 may actively provide pressure to the mine roof 208 and/or mine floor 210. Preferably, the support member 202 is oriented perpendicular to the mine roof 208 and/or mine floor 210 and extends vertically with respect to the gate entry 102, 104.

The support member 202 in one embodiment may include a head plate 212, a foot plate 214, and an extension member 216. The head plate 212 engages the mine roof 208. Preferably, the head plate 212 is a steel reinforced plate with an angled front 218 and an angled back 220. The angled front 218 and back 220 permit the head plate 212 to slide past irregularities in the mine roof 208. Preferably, the head plate 212 is substantially planar. Alternatively, the head plate 212 is curved or otherwise formed to conform to the contour of the mine roof 208.

The foot plate 214 engages the mine floor 210. Preferably, the foot plate 214 is a steel reinforced plate with an angled front 222 and an angled back 224. The angled front 222 and back 224 permit the foot plate 214 to slide past irregularities in the mine floor 210. Preferably, the foot plate 214 is substantially planar. Alternatively, the foot plate 214 is curved or otherwise formed to conform to the contour of the mine floor 210.

The extension member 216 extends from a retracted position 226 to an extended position 228. In the retracted position 226, the extension member 216 draws the head plate 212 (in phantom) and foot plate 214 (in phantom) in close proximity to the vehicle 206 such that the height of the apparatus 200 is minimized. In the extended position 228, the extension member 216 extends the head plate 212 and foot plate 214 to respectively engage the mine roof 208 and mine floor 210. In certain embodiments, the foot plate 214 and vehicle 206 are integrated into a single unit. The extension member 216 preferably extends and retracts the head plate 212 and/or the foot plate 214 in response to a control signal from the controller 204. Alternatively, or in addition, the extension member 216 may include manual controls that permit a worker to extend or retract the head plate 212 and/or the foot plate 214. In certain embodiments, the extension member 216 communicates with a sensor that indicates how much pressure the extension member 216 is exerting against the mine roof 208 and/or mine floor 210.

In certain embodiments, the apparatus 200 comprises a plurality of extension members 216. In addition, the head plate 212 and/or foot plate 214 may be divided to provide more flexibility in how the pressure is distributed to the mine roof 208 or mine floor 210. In one embodiment, the extension member 216 comprises a hydraulic ram that includes a fluid chamber and a telescoping piston. The hydraulic ram may be coupled to a pressurized hydraulic fluid supply 230 by a plurality of hydraulic hoses 232. The hydraulic fluid supply 230 may be on the apparatus 200. Alternatively, the hydraulic fluid supply 230 is remotely connected by the hoses 232 to one or more hydraulic rams.

The controller 204 directs the operation of the support member 202 and//or the vehicle 206. Preferably, the controller 204 is coupled by electronic communication links such as wired control signals, wireless control signals, or radio control signals to direct and control extension of the extension member(s) 216 of the support member 202 to engage the mine roof 208 and mine floor 210. Preferably, different control signals from the controller 204 retract the head plate 212 and/or foot plate 214 to disengage the apparatus 200 from the mine roof 208 and/or mine floor 210. The controller 204 is preferably an electronic device designed to operate in the harsh conditions of underground mining. The controller 204 may be coupled to the apparatus 200 or part of other controllers for a long wall 134. A power supply for the controller 204 may reside on the apparatus 200 or be provided by a remote power supply (not shown) through a cable.

In one embodiment, the controller 204 is programmed with microcode to extend or retract the head plate 212 or foot plate 214 independent of each other. Alternatively, the controller 204 may extend or retract the head plate 212 and/or foot plate 214 with equal amounts of pressure. Preferably, the controller 204 is configured to take up minimal space such that the overall profile of the apparatus 200 viewed from one end is minimal such that airflow is minimally impeded.

The vehicle 206 is preferably connected to the support member 204 and controller 204. The vehicle 206 serves to facilitate movement of the apparatus 200 for initial positioning and repositioning during full extraction mining operations. The vehicle 206 moves the support member 204 in response to a motive force. In certain embodiments, the motive force is a push or a pull force provided by other mining equipment. For example, a hook 234 of the vehicle 206 may be used to pull the apparatus 200 forward using a chain and mine equipment mover once the head plate 212 and/or foot plate 214 are at least partially retracted.

Those of skill in the art will recognize that the vehicle 206 may comprise a passive vehicle such as a sled or dolly. Alternatively, the vehicle 206 may comprise a drive vehicle 206 that includes means for moving the apparatus 200 under an motive force generated by the drive vehicle 206. For example, the drive vehicle 206 may include a motor 236 that provides the motive force to wheels, tracks, crawling feet or other means 238 for moving the apparatus 200 forward or backward. The motor 236 may comprise an electric motor, a hydraulic motor, or an internal combustion motor. Preferably, the motor 236 of the drive vehicle 206 responds to control commands from the controller 204. Consequently, the drive vehicle 206 may comprise a tram, a crawler, a dolly, a walking base, a sled, or a horizontal ram that acts on an anchor such as an anchor bolt or a mobile roof support 116 of the longwall 134.

In a preferred embodiment, the support member 202, controller 204, and vehicle 206 are not physically connected to, or constrained by a mining face conveyor 118. Because the apparatus 200 is not physically constrained by a mining face conveyor 118, the apparatus 200 can be operated independent of a longwall 134. In particular, the apparatus 200 can be used in room and pillar mining for retreat mining. For example, the independent movement and operation of the apparatus 200 provides additional support and moveable, reusable supports in a pillar line or cave line area for room and pillar mining. In addition, the independent movement and operation of the apparatus 200 allows the apparatus 200 to be used in other areas of a mine having known weak ground conditions typically for a relatively short period of time.

In certain embodiments, the apparatus 200 includes a back canopy 240. The back canopy 240 may serve to prevent falling roof material from damaging or covering other components of the apparatus 200. The back canopy 240 may be useful in extraction mining such as pillar mining where the mine roof 208 is permitted to collapse behind the apparatus 200. Preferably, the back canopy 240 is configured to extend a majority of the height of the gate entry 102, 104. The back canopy 240 is further configured to provide protection from falling material regardless of the height of the head plate 212. Of course, a canopy 240 similar to a back canopy 240 can be connected to the front or sides of the head plate 212.

In one embodiment, the apparatus 200 comprises a powered roof support having at least one hydraulic leg that serves as the support member 202. The powered roof support may include a vehicle 206 or other motive means for moving the powered roof support within the gate entry 102, 104. The powered roof support may also include a back canopy 240. Preferably, the back canopy 204 is configured to facilitate airflow passage while still keeping material away from the apparatus 200, as further described in relation to FIG. 4A. Of course, a canopy 240 similar to a back canopy 240 can be connected to the front or sides of the head plate 212.

In certain embodiments, the apparatus 200 comprises an existing support selected from the group of support members comprising a shield support, a chock support, a chock shield support, and a mobile roof support. Each of these existing supports may be modified and adapted to move forward within the gate entry or a connecting entry. For example, in one embodiment a pair of existing supports may be coupled together by a bar. The coupled pair of existing supports may then cooperate to walk forward within the gate entry or a connecting entry to reposition the apparatus 200. One existing support may engage the mine roof 208 and mine floor 210 to provide an anchor of the other existing support to use to move within the gate entry. Preferably, use of existing supports includes modification, removal, or adaptation of any existing canopies on the existing supports such that airflow past the existing support is maximized.

Figure 3:
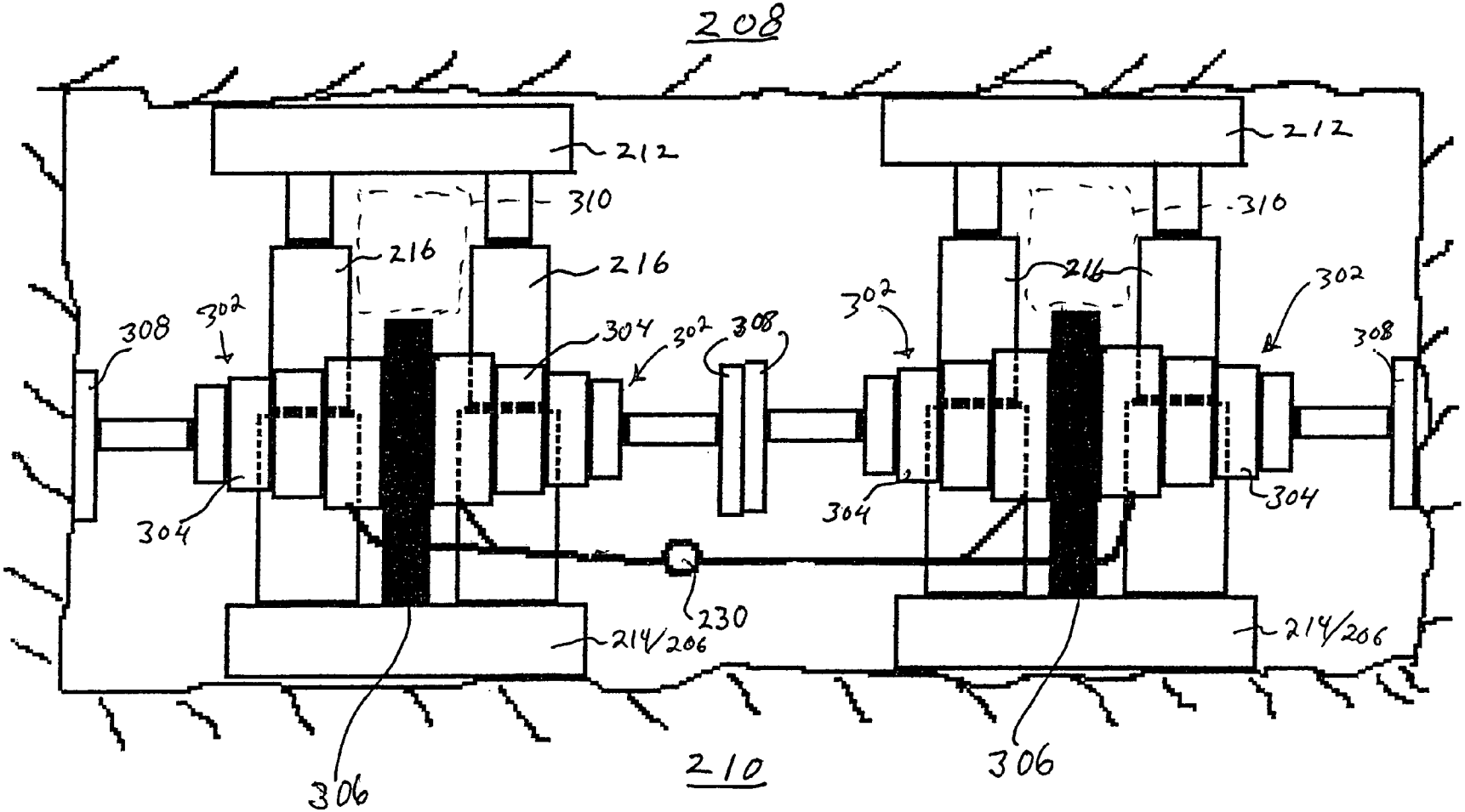
FIG. 3 is an end-view illustrating an aligned profile of an apparatus for supporting a gate entry for underground full extraction mining.

FIG. 3 illustrates an end view of one embodiment of an apparatus 300 for supporting a gate entry 102, 104 for underground full extraction mining. The apparatus 300 includes certain components in common with the embodiment described in relation to FIG. 2. These common components are identified by common reference numerals. Preferably, the apparatus 300 includes a support member 202 that extends vertically. The support member 202 includes one or more extension members 216, a head plate 212, and a foot plate 214.

Preferably, the apparatus 300 includes at least one lateral extension member 302. In certain embodiments, the apparatus 300 includes a pair of opposing lateral extension members 302. The lateral extension member 302 may include substantially the same components as the extension member 216. For example, the lateral extension member 302 may include a hydraulic ram 304 that includes a fluid chamber, one or more telescoping pistons, and a side plate 308. A base of the hydraulic ram 304 may be secured to a frame member 306.

The hydraulic ram 304 may also be coupled to the side plate 308. The lateral extension member 302 is configured to extend and retract laterally in response to suitable extend or retract control signals. Preferably, the control signals are provided by the controller 204. The lateral extension member 302 extends to engage a wall of the gate entry 102, 104 with the side plate 308. The lateral extension member 302 retracts the side plate 308 to disengage from a gate entry wall. Preferably, the side plate 308 is a metal planar structure. Alternatively, the side plate 308 is contoured to match a contour of the gate entry wall.

In a preferred embodiment, the apparatus 300 is configured such that all the components of the apparatus 300 cooperate and are positioned in order to minimize the profile of the apparatus 300 when viewed from each end as illustrated in FIG. 3. For example, a plurality of extension members 216 may be aligned. In addition, rather than a single wide extension member 216 a plurality of narrower extension members 216 may be aligned within each other in order to provide suitable load capacity but minimize the end profile. In addition, the controller 204, motors 236, and hydraulic fluid supply 230 may be aligned. The head plate 212, foot plate 214, and side plates 308 may be as thin as possible in order to minimize the end profile of the apparatus 300. In this manner, the passages 310 for airflow are maximized. Consequently, airflow past the apparatus 300 is maximized, provided the apparatus 300 is positioned parallel to the gate entry 102, 104.

Figure 4A:
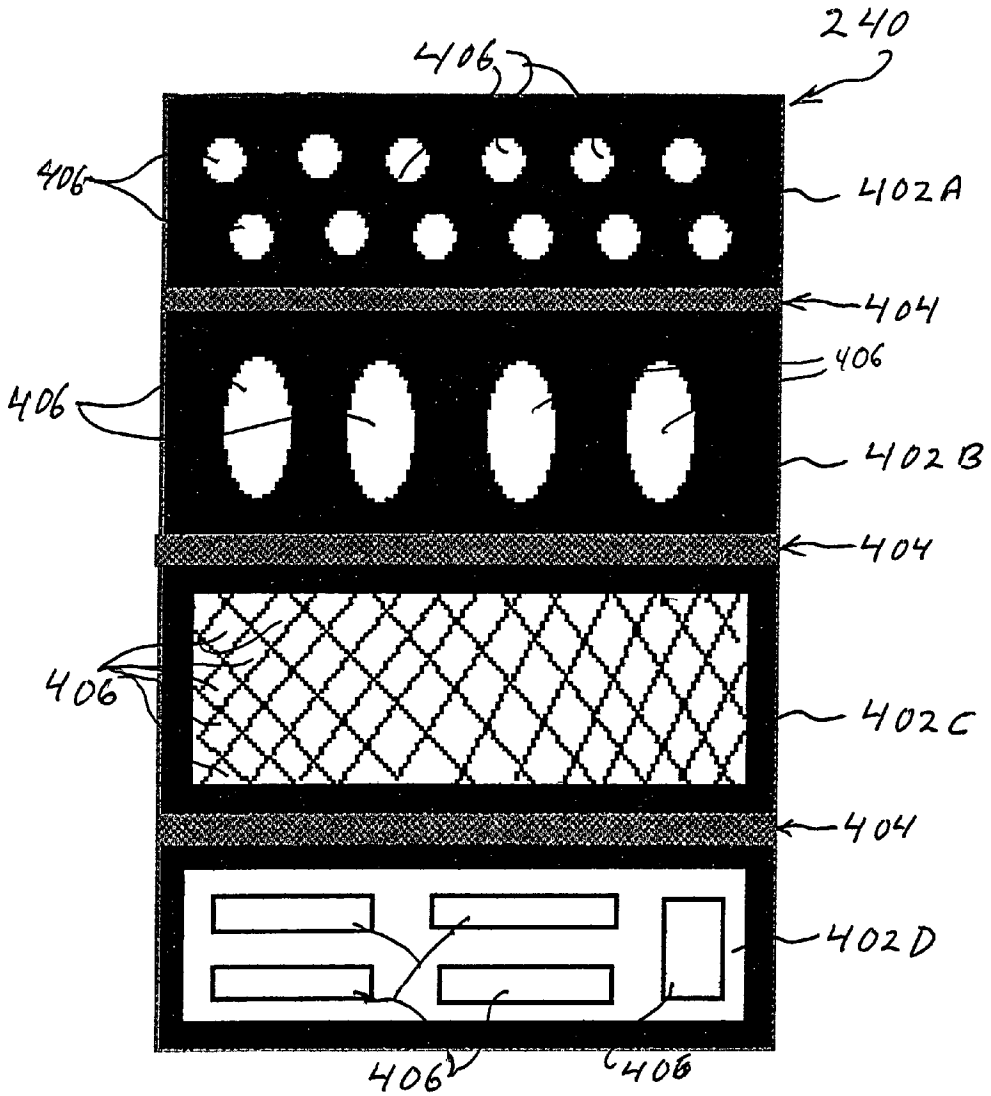
FIG. 4A is a plan view illustrating one embodiment of a canopy of one embodiment of the present invention, the canopy includes different opening to facilitate airflow passage.

FIG. 4A illustrates one embodiment of a canopy 240 suitable for use with one embodiment of the present invention. The canopy 240 may comprise a wire mesh or a rigid set of panels 402. The set of panels 402 may be joined by hinges 404. Preferably, each panel 402 comprises a set of openings designed to provide sufficient rigid structural integrity in order for the canopy to function while also permitting as much air to pass through the canopy 240 as possible. Preferably each panel 402 has the same pattern of openings. FIG. 4A illustrates panels 402A-D with different opening patterns that may be used in various embodiments.

In panel 402A, the panel openings 406 may comprises a pattern of circles. In panel 402B, the panel openings 406 comprise a plurality of ovals. In panel 402C, the panel openings 406 may comprise holes in a square wire mesh. In panel 402D, the panel openings 406 may comprise rectangles. Those of skill in the art will understand that the panel openings 406 may take on various other configurations and still fall within the scope of the present invention.

Figure 4B:
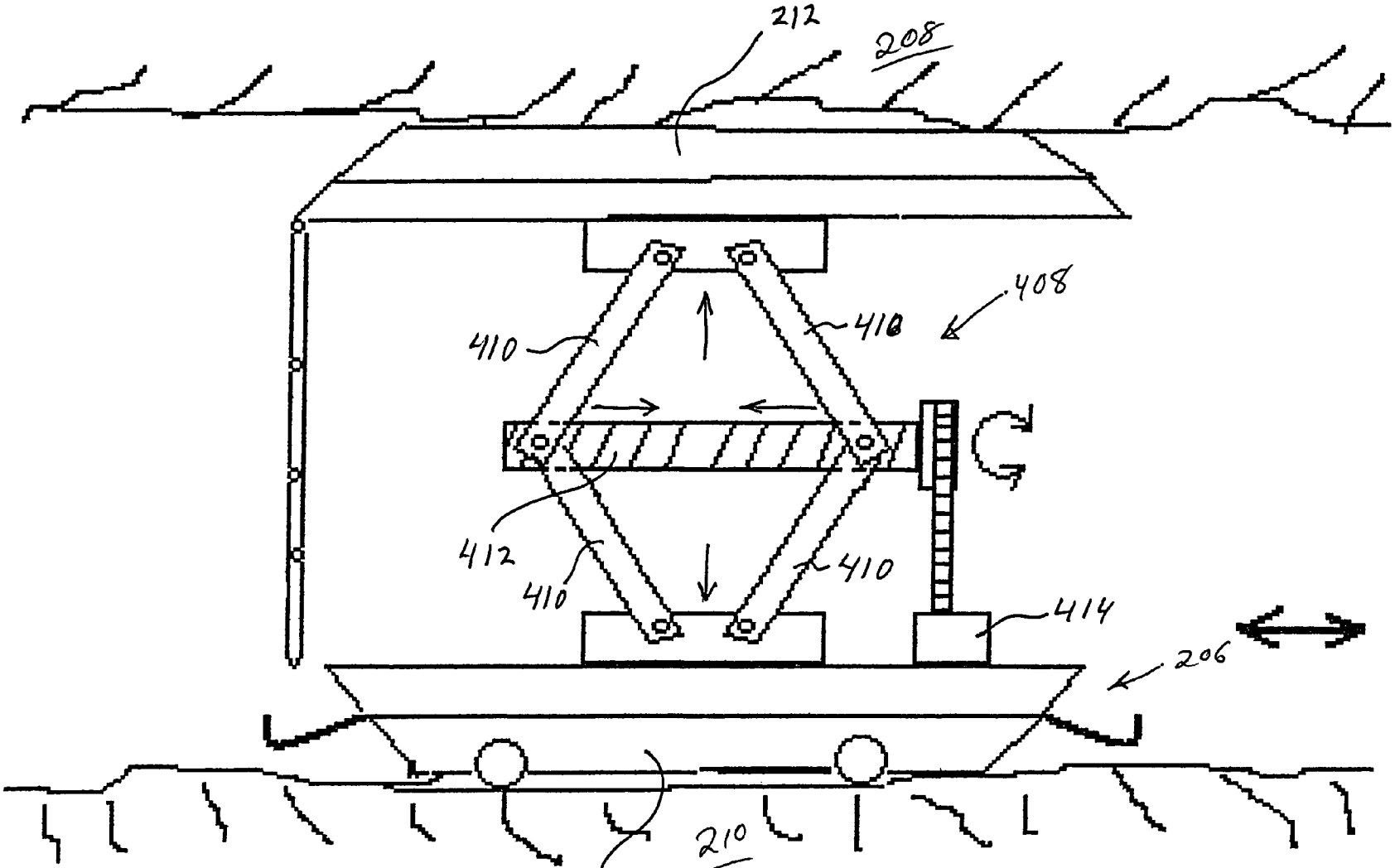
FIG. 4B is a side view illustrating one embodiment of an extension member.

FIG. 4B illustrates a side view of one embodiment of an extension member 408. The extension member 408 may be used in place of the extension member 216 described in relation to FIG. 2. In contrast to the extension member 216 the extension member 408 is a mechanical support configured to translate a mechanical force into an extension force. The mechanical extension member 408 may also be used in place of hydraulic lateral extension members 304 described in relation to FIG. 3.

In one embodiment, the mechanical extension member 408 includes arms 410 connected to a screw rod 412. Turning the screw rod 412 in one direction may move the arms 410 along the screw rod 412 toward each other. This mechanical force turning the screw rod 412 is translated into an extension force that cases the plates, such as a head plate 212 and a foot plate 214 to separate. Turning the screw rod 412 in the opposite direction causes the plates 212, 214 to retract and come close together. The screw rod 412 may be turned manually or by way of a linkage such as a drive belt or chain connected to a motor 414.

Figure 5:
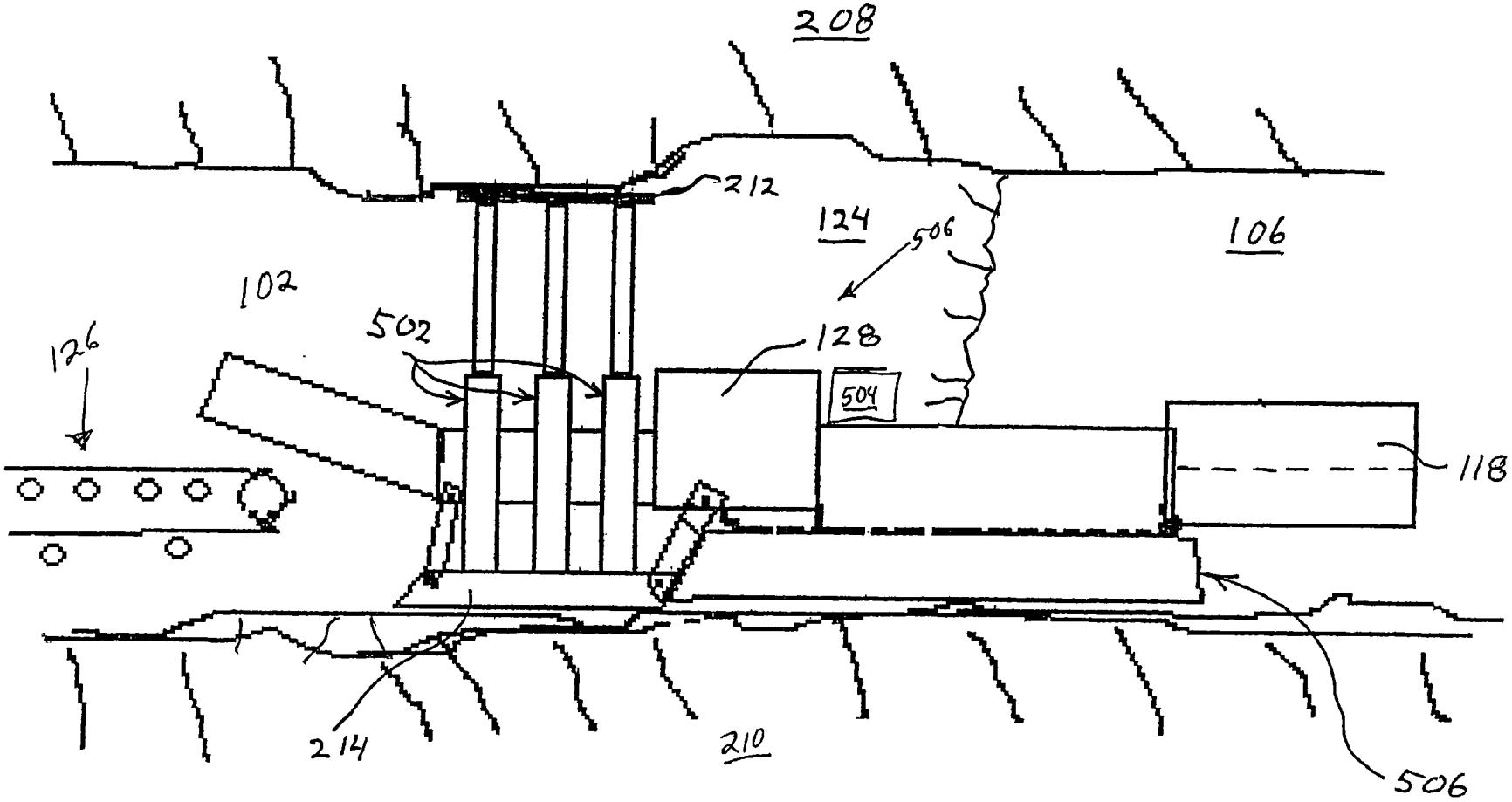
FIG. 5 is a side view illustrating one embodiment of a system for supporting a gate entry for underground full extraction mining.

FIG. 5 illustrates one embodiment of a system 500 for supporting a gate entry 102 for underground full extraction mining. The system 500 includes certain components in common with the embodiments described in relation to FIGS. 1 and 2. These common components are identified by common reference numerals. The system 500 preferably includes one or more hydraulic support members 502 connected to a head plate 212 and a foot plate 214. The system 500 also includes a controller 504 that operates substantially the same as the controller 204 described above in relation to FIG. 2. The hydraulic support members 502 respond to control commands from the controller 504. The system 500 includes a stage loader 506 similar to the stage loader 122 described in relation to FIG. 1. However, the stage loader 506 is coupled to the hydraulic support members 502. The stage loader 506 is within the gate entry 102. Consequently, the stage loader 506 is configured to move the hydraulic support members 502 when the stage loader 506 moves. The stage loader 506 may be moved in response to advancement of a longwall face 105. Preferably, the controller 504 communicates with or operates in concert with a controller for the stage loader 506 such that when the stage loader 506 is prepared to move the controller 504 retracts the hydraulic support members 502 to facilitate such movement.

In certain embodiments, the hydraulic support member 502 is a support member selected from the group of support members comprising a shield support, a chock support, a chock shield support, and a mobile roof support. Each of these existing forms of support may be modified and adapted to be coupled to the stage loader 506 such that movement of the stage loader 506 also moves the hydraulic support member 502. Alternatively, movement of the hydraulic support member 502 may cause the stage loader 506 to move. Alternatively, the hydraulic support member 502 may be specifically engineered to operate as part of a stage loader 506.

In a preferred embodiment, the hydraulic support member 502 and controller 504 are configured to maximize airflow past the system 500. For example, the controller 504 may be positioned directly in-line with an existing component such as the crusher 128 such that adding the controller 504 does not further impede airflow. Similarly, the width of the hydraulic support member 502 may be selected in order to minimize interference with airflow past the system 500. In one embodiment, a plurality of hydraulic support members 502 are used instead of one larger width hydraulic support member 502. Furthermore, where a plurality of hydraulic support members 502 are used these hydraulic support members 502 may be aligned such that the end profile of the system 500 is minimized. The system 500 illustrates one set of hydraulic support members 502. Of course, the system 500 may include a plurality of sets of hydraulic support members 502 each with its own head plate 212 and foot plate 214.

Figure 6:
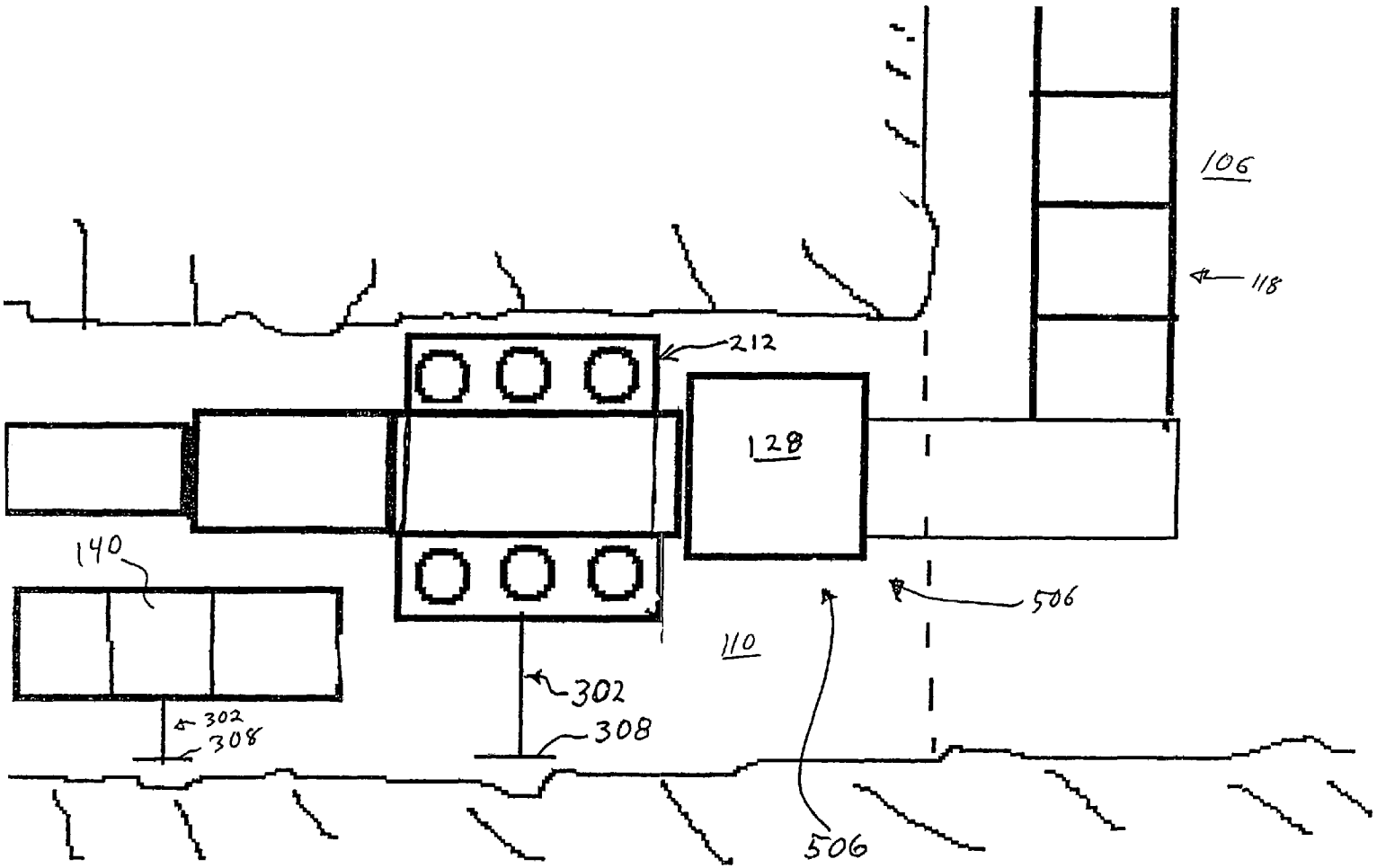
FIG. 6 is a top plan view illustrating one embodiment of a system for supporting a gate entry for underground full extraction mining.

FIG. 6 illustrates a top plan view of a system 600 for supporting a gate entry 102 for underground full extraction mining. The system 600 includes hydraulic support members 502 with head plates 212 such as those on the system 500 in FIG. 5. The system 600 also includes lateral extension members 302 similar to the lateral extension members of FIG. 3. Preferably, the lateral extension members 302 are physically coupled to the stage loader 506. In a preferred embodiment, the lateral extension members 302 oppose each other. In certain embodiments the lateral extension member 302 on one side may be configured to extend further than the lateral extension member on the opposite side. This may be useful in mining operations in which the stage loader 506 is not centered between the walls of the gate entry 102. In this manner, the longer lateral extension member 302 is configured to move the side plate 308 sufficiently to engage the opposing gate entry wall.

In other embodiments, the lateral extension members 302 are positioned nearer the mine floor 210 than the mine roof 208. In this manner, the lateral extension members 302 facilitate passage over the lateral extension members 302 by personnel accessing the mining face 106 or exiting the mining face 106. Alternatively, the lateral extension members 302 are positioned nearer the mine roof 208 than the mine floor 210. As described above, the lateral extension members 302 may be selectively extended and retracted as needed to engage the walls of the gate entry 102. Selective extension and retraction of one lateral extension member 302 or the other may be controlled by suitable control signals.

Figure 7:
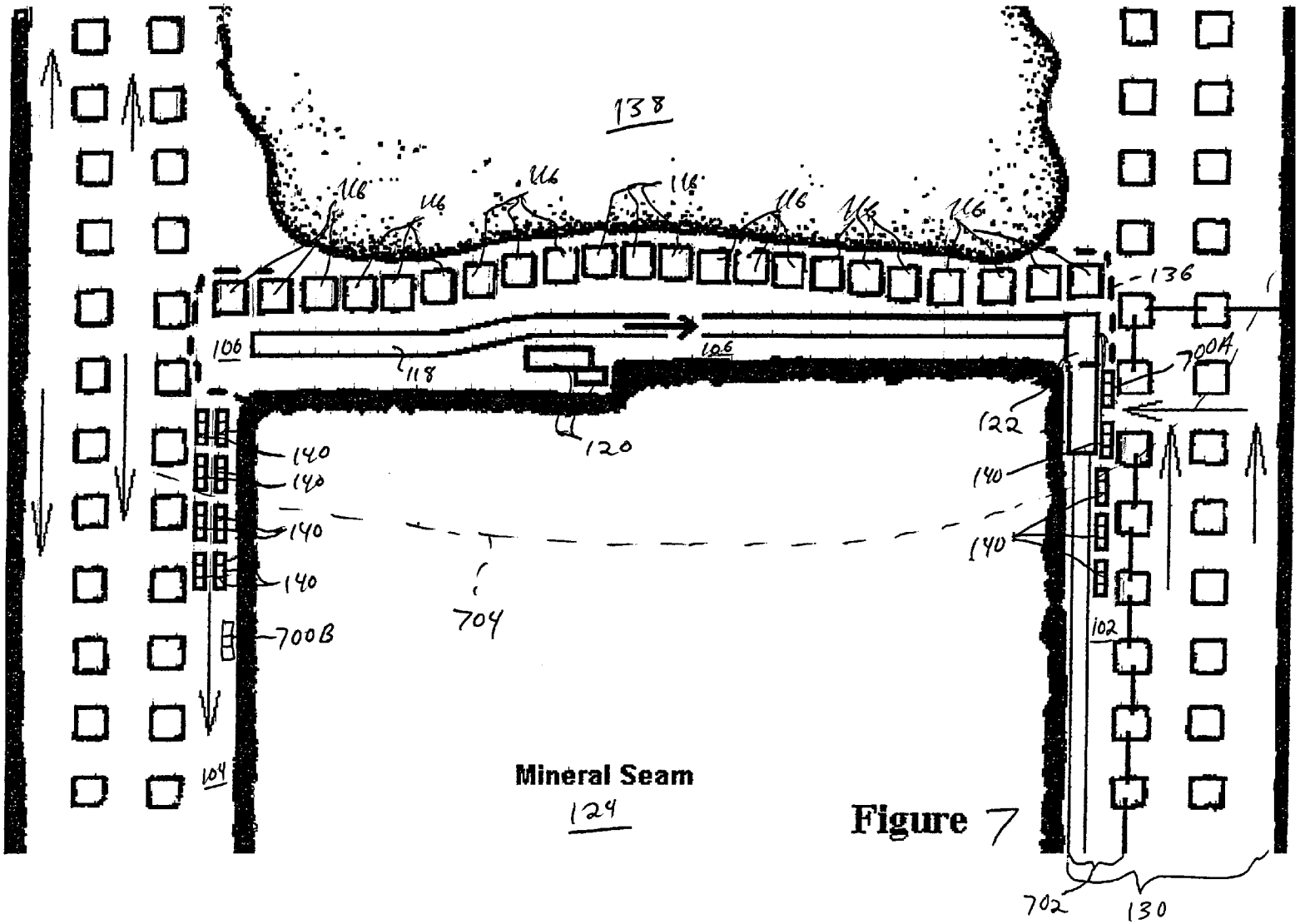
FIG. 7 is a schematic block diagram illustrating one embodiment of a mining layout for supporting one or more gate entries for underground full extraction mining using apparatuses in accordance with the present invention.

FIG. 7 illustrates one embodiment of a mining layout for supporting one or more gate entries for underground full extraction mining using a movable support apparatus 700 in accordance with the present invention. The apparatus 700 may comprise the apparatus 140 illustrated in FIG. 1, the apparatus 200 described in relation to FIG. 200, or the apparatus 300 described in relation to FIG. 3. The apparatus 700 includes a support member 202, a controller 204, and a vehicle 206 coupled together and independent of a mining face conveyor 118.

Initially, before full extraction mining begins, the apparatus 700A is positioned within a headgate 130. Optionally, an apparatus 700B may be positioned within the tailgate 132. The apparatus 700A-B are preferably positioned parallel to the gate entry 102, 104. Preferably, each apparatus 700A-B is positioned within a gate entry 102, 104 to form an access passage 702. The access passage 702 provides a passage way for equipment, personnel, and air to move freely between other parts of a mine and the mining face 106. Preferably, the access passage 702 includes the width of the apparatus 700A-B with respect to airflow because the end profile of the apparatus 700A-B is minimal.

In addition, the apparatus 700B may be strategically positioned just ahead of a front abutment loading 704. Positioning of the apparatus 700A-B may include extending the extension member 216 to engage the mine roof 208 and mine floor 210. One or more extension members 216 may support between about 100 tons and about 2000 tons. Alternatively, or in addition, one or more lateral extension members 302 are extended to engage walls of the gate entry 102, 104. Preferably, the extension members 216 and/or lateral extension members 302 extend in response to a control signal from the controller 204.

Advantageously, the apparatuses 700A-B are not required to assist in keeping the mining face conveyor 118 aligned with a stage loader 122 or transport conveyor 126. Consequently, the apparatuses 700A-B provide more flexibility in providing support where needed. The apparatuses 700A-B can operated and moved independent of the operation and movement of the mining face conveyor 118 or other longwall equipment.

Positioning of the apparatuses 700A-B may also include positioning of support cabling and support hoses for extraction mining equipment. Preferably, the support cabling and support hoses are positioned within the access passage. The apparatuses 700A-B prevent cave ins such as wall, floor, or roof failures that may cover to damage the support cabling and support hoses.

Next, full extraction mining operations are conducted. As the mining face 106 moves into the gate entries 130, 132, the front abutment loading 704 moves further into the mineral seam 124. Advantageously, the apparatus 700B was positioned within an area of the gate entry 104 having weak structural conditions. Consequently, as the front abutment loading 704 arrives over the weak area of the gate entry 104, the apparatus 700B is providing positive support to the area so that failure of the gate entry 104 can be prevented.

As full extraction mining shortens the gate entries 102, 104 and the apparatuses 700A-B begin to enter the mining face 106, an operator may operate the controller 204 to reposition the apparatuses 700A-B further down along the length of the gate entry 102, 104. The apparatuses 700A-B may advance using contact advance or non-contact advance. Repositioning of the apparatuses 700A-B allows for reuse of the apparatuses 700A-B and facilitates keeping the access passage 702 substantially unblocked during full extraction mining operations. Advantageously, the controller 204 may be controlled remotely via a wired or wireless communication channel.

Figure 8A:
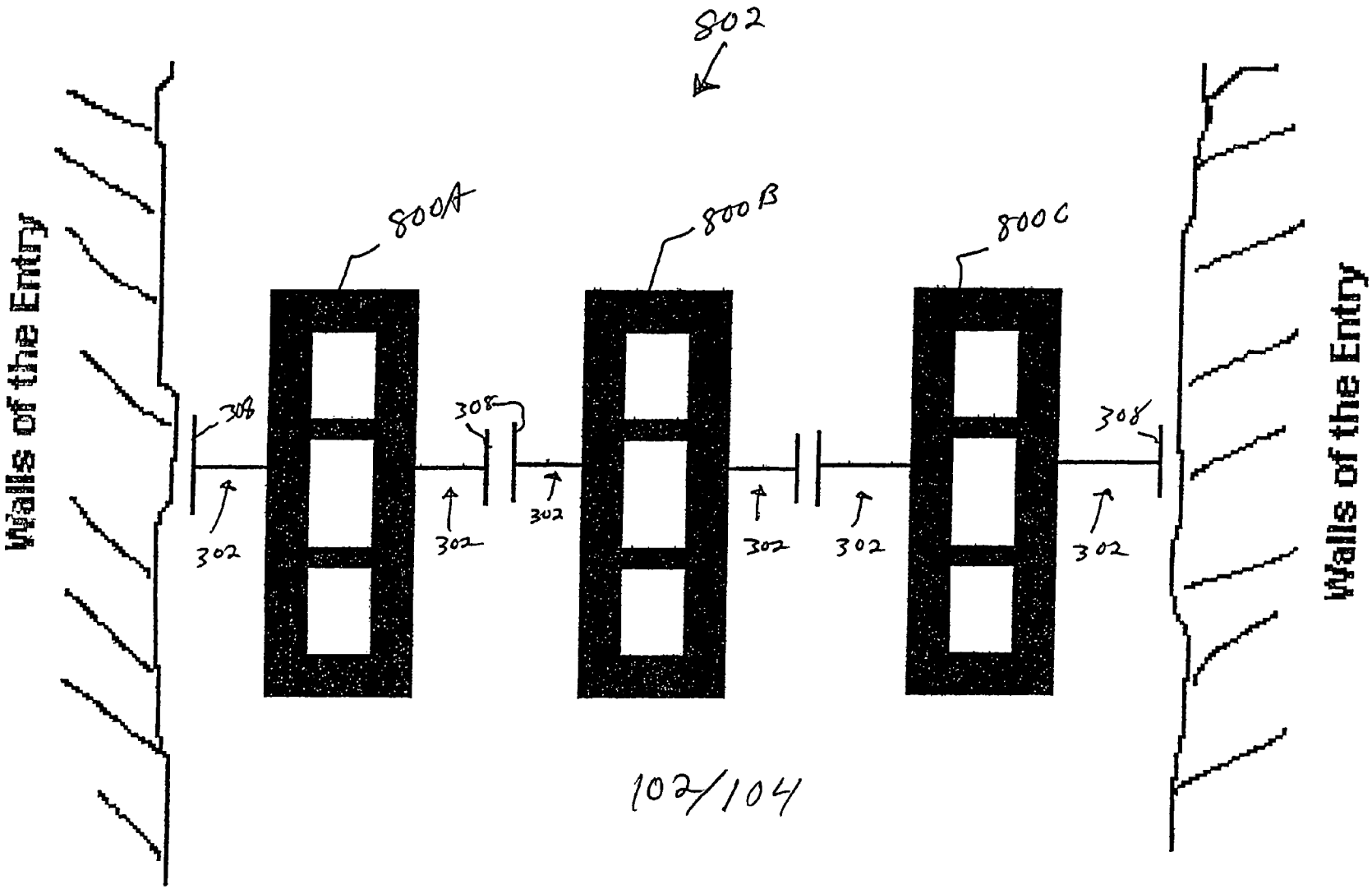
FIG. 8A is a block diagram illustrating a placement pattern for a plurality of apparatuses for supporting a gate entry for underground full extraction mining.
Figure 8B:
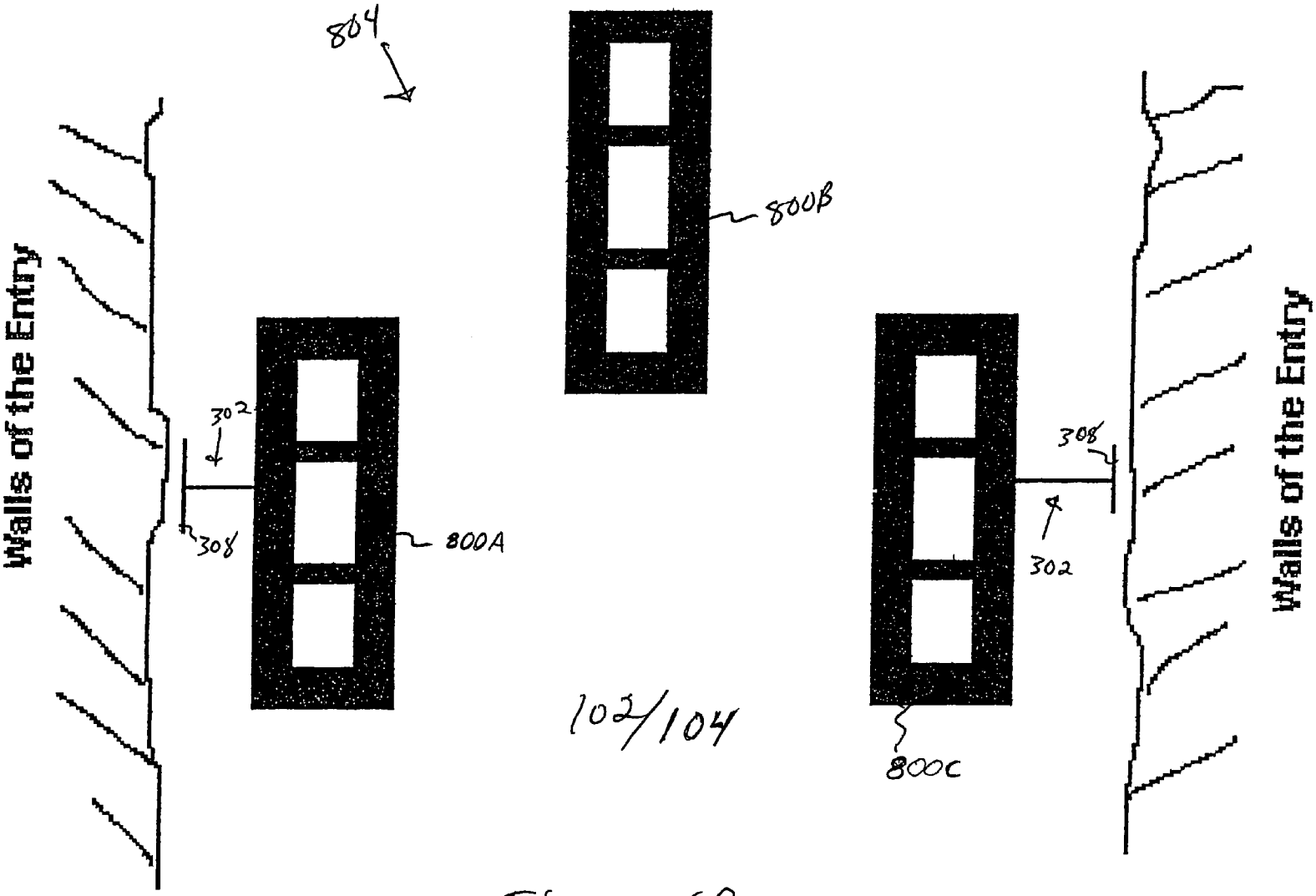
FIG. 8B is a block diagram illustrating a placement pattern for a plurality of apparatuses for supporting a gate entry for underground full extraction mining.
Figure 9:
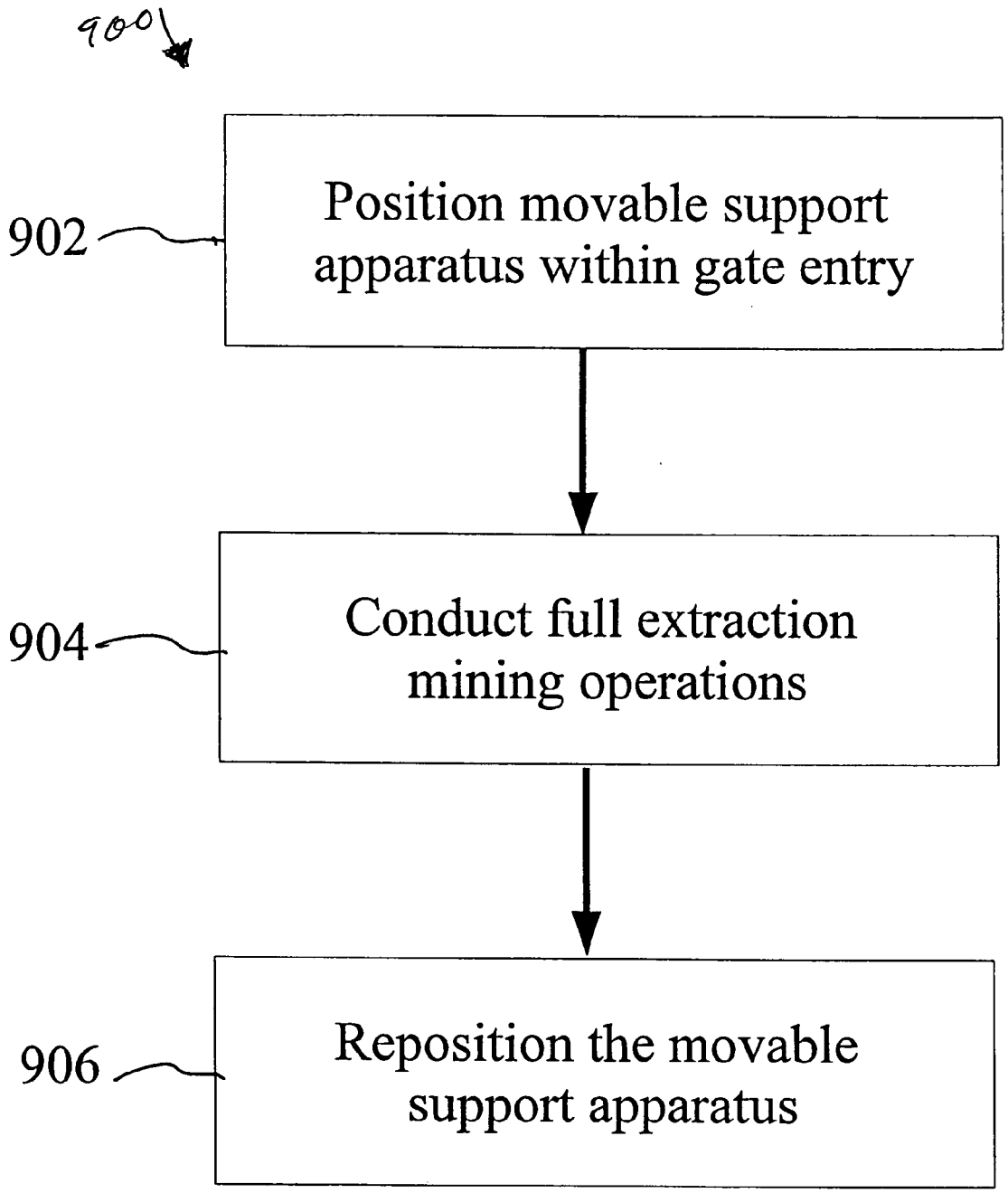
FIG. 9 is a schematic flow chart diagram illustrating one embodiment of a method for supporting a gate entry for underground full extraction mining in accordance with the present invention.

FIGS. 8A and 8B illustrated two example placement patterns for positioning a plurality of apparatuses 800A-C.

The apparatuses 800A-C may comprise the apparatus 140 illustrated in FIG. 1, the apparatus 200 described in relation to FIG. 200, or the apparatus 300 described in relation to FIG. 3. Preferably, the method of the present invention comprises positioning of a plurality of apparatuses 800A-C. These apparatuses 800A-C are preferably placed according to a placement pattern. A first placement pattern 802 comprises aligning the apparatuses 800A-C transverse to the gate entry 102, 104. The support member 202 for each apparatus 800 may be extended to engage the mine roof 208 and mine floor 210. In addition, each lateral extension member 302 may be extended such that apparatuses 800 between neighboring apparatuses such as apparatus 800B engage the side plates 308 of neighboring apparatuses 800A,C.

Similarly, in placement pattern 804, apparatus 800A and apparatus 800C each engage the mine roof 208 and mine floor 210 as well as opposing walls of the gate entry 102, 104. Apparatus 800B may be further down the gate entry 102, 104 and engage simply the mine roof 208 and mine floor 210.

Those of skill in the art will recognize that various other placement patterns may be used with the present invention. All such placement patterns are considered within the scope of the present invention.

The schematic flow chart diagram included is generally set forth as a logical flow chart diagram. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

FIG. 6 illustrates a method 900 for supporting a gate entry for underground full extraction mining. The method 900 may use the apparatus 140 illustrated in FIG. 1, the apparatus 200 described in relation to FIG. 200, and/or the apparatus 300 described in relation to FIG. 3. The method 900 begins by positioning 902 one or more mobile support apparatuses 140, 200, 300 within a gate entry 102, 104. Next, full extraction mining operations are conducted 904. Finally, as the mining face 106 moves into the gate entry 102, 104, the moveable support apparatuses 140, 200, 300 are repositioned 906.

Figure 10:
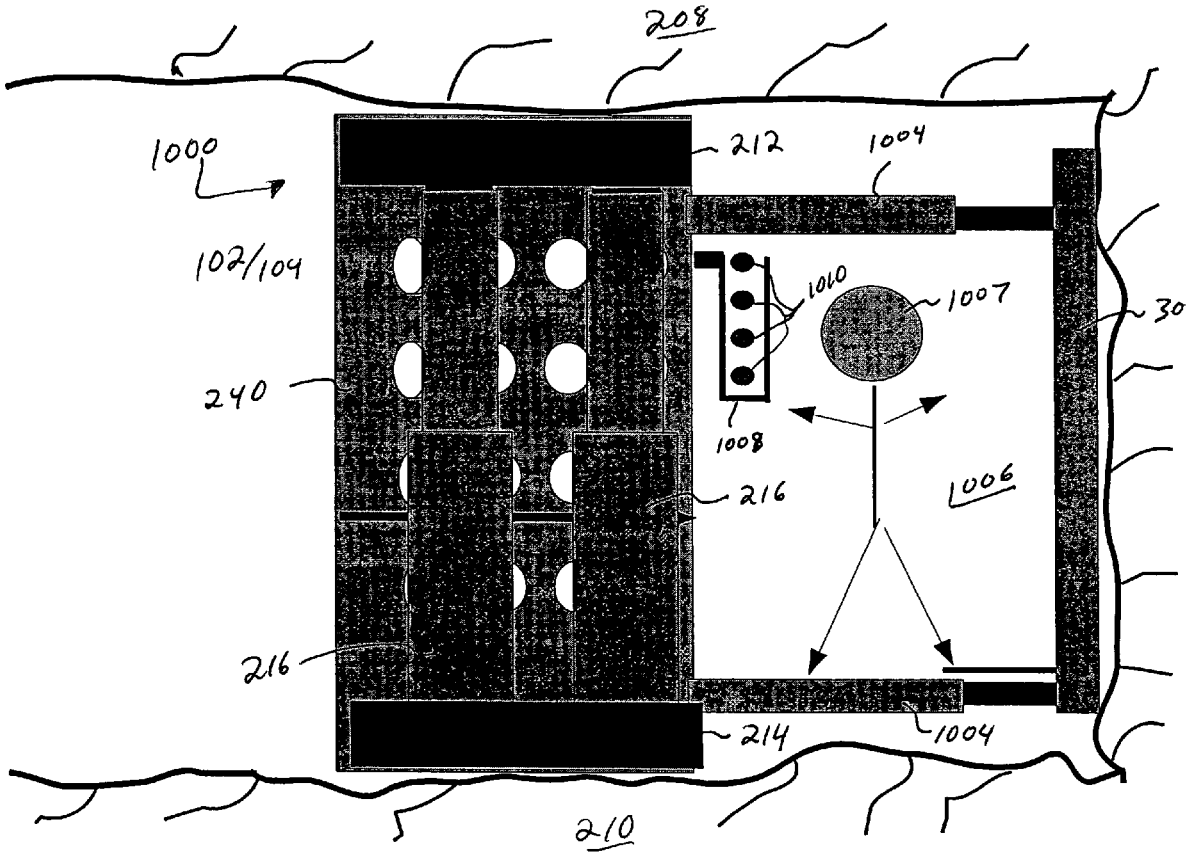
FIG. 10 is a block diagram illustrating one embodiment of an apparatus for supporting a gate entry configured to support one or more walls of the gate entry and provide an access way for equipment and personnel to pass by the apparatus.

FIG. 10 illustrates one embodiment of an apparatus 1000 for supporting a gate entry configured to support one or more walls of the gate entry and provide an access way for equipment and personnel to pass by the apparatus. The apparatus 1000 may comprise the apparatus 140 illustrated in FIG. 1, the apparatus 200 described in relation to FIG. 200, or the apparatus 300 described in relation to FIG. 3.

The apparatus 1000 includes a top plate 212, a foot plate 214, and one or more extension members 216. In addition, the apparatus 1000 includes one or more lateral extension members 1002. The lateral extension member 1002 is similar to the extension member 302 described in relation to FIG. 3. However, the lateral extension member 1002 may comprise a pair of rams 1004. Preferably, the rams 1004 are spaced vertically with respect to the apparatus 1000 such that a passage way 1006 is formed between a side plate 308 and the apparatus 1000. Preferably, one ram 1004 is positioned near a mine roof 208 and the other ram is positioned near a mine floor 210. The passage way 1006 permits equipment and personnel 1007 to pass by the apparatus 1000 with the lateral extension member 1002 extended and engaging a gate entry wall.

In addition, the passage way 1006 may include one or more hooks 1008 or other similar structures for holding and retaining a plurality of cables and hoses 1010. Advantageously, the keeps the cables and hoses 1010 up off the floor to further aide in access past the apparatus 1000.

In this manner, the apparatus, system, and method for supporting a gate entry 102, 104 is reusable, operates independent of a mining face conveyor, provides for both mine roof and mine floor support. In addition, the apparatus, system, and method provides for selective lateral support of gate entry walls. The apparatus, system, and method is mobile and comprise a minimal width profile to provide support while minimizing interference with the airflow within the gate entry. In addition, the apparatus, system, and method forms an access passage for both personnel, equipment, and airflow that remains safely open during full extraction mining operations even as a load abutment shifts due to full extraction mining.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for supporting a gate entry for underground retreat longwall mining, the apparatus comprising:

a support member comprising a head plate configured to engage a mine roof, a foot plate configured to engage a mine floor, and a hydraulic extension member configured to selectively engage the mine roof of a gate entry with the head plate and the mine floor of the gate entry with the foot plate and support a front abutment loading;

a controller in communication with the support member, the controller configured to extend the hydraulic extension member to engage the mine roof and mine floor and retract the hydraulic extension member to disengage the mine roof and mine floor;

a lateral extension member configured to extend and retract laterally to selectively engage a wall of the gate entry in response to a control signal to define a passage way between the wall of the gate entry and the apparatus, the lateral extension member comprising a side plate and two or more hydraulic rams coupled to the side plate, the lateral extension member configured to maximize the size of the passage way to facilitate safe ingress and egress of personnel;

a vehicle connected to the support member and controller, the vehicle configured to move the support member in response to a motive force acting on the vehicle; and wherein the support member, controller, and vehicle are independent of a mining face conveyor.

2. The apparatus of claim 1, wherein the apparatus is rectangular having a short side and long side and wherein the head plate, foot plate, hydraulic extension member, and vehicle are configured to produce a streamlined profile that maximizes airflow past the apparatus, the streamlined profile defined by viewing the apparatus perpendicular to a short side.

3. The apparatus of claim 1, the lateral extension member comprising a hook secured to the apparatus above the floor of the gate entry, the hook configured to retain one or more cables or hoses such that the cables or hoses do not impede passage by personnel through the passage way.

4. The apparatus of claim 1, wherein the vehicle comprises a drive vehicle having a motor configured to generate the motive force and move the drive vehicle in response to a control signal.

5. The apparatus of claim 1, wherein the apparatus is rectangular having a short side and long side and wherein the head plate, foot plate, hydraulic extension member, and vehicle are configured to minimize the length of the short side such that positioning the apparatus parallel to a longitudinal axis of a gate entry maximizes airflow past the apparatus.

6. The apparatus of claim 5, wherein the hydraulic extension member is coupled to a pressurized hydraulic fluid supply.

7. The apparatus of claim 1, wherein the support member comprises at least two hydraulic extension members configured to engage the mine roof and mine floor to support between about 100 tons and about 2000 tons of a front abutment loading in a tailgate.

8. The apparatus of claim 1, wherein the vehicle is a movable member selected from the group consisting of a tram, a crawler, a dolly, a walking base, a sled, and a horizontal ram configured to act on an anchor, the foot plate comprising an angled front and an angled back to facilitate sliding past irregularities of the mine floor.

9. A mining system for supporting a gate entry for underground retreat longwall mining, the mining system comprising:

a longwall face of a mineral seam having a front abutment loading positioned in advance of the longwall face;

a hydraulic support member comprising a head plate configured to selectively engage a mine roof, a foot plate configured to engage a mine floor, and a hydraulic extension member configured to selectively engage the mine roof of a gate entry with the head plate and the mine floor of the gate entry with the foot plate;

a lateral extension member configured to extend and retract laterally to selectively engage a wall of the gate entry in response to a control signal to define a passage way between the wall of the gate entry and the apparatus, the lateral extension member comprising a side plate and two or more hydraulic rams coupled to the side plate, one ram positioned near a mine roof and the other ram positioned near a mine floor to maximize the size of the passage way to facilitate safe ingress and egress of personnel;

a controller in communication with the hydraulic support member, the controller configured to extend the hydraulic extension member to engage the mine roof and mine floor and retract the hydraulic extension member to disengage the mine roof and mine floor; and a vehicle connected to the hydraulic support member and controller, the vehicle configured to move the hydraulic support member in response to a motive force acting on the vehicle, the vehicle positioned within the front abutment loading.

10. The system of claim 9, wherein the front abutment zone comprises an area in the gate entry between about 5 feet and about 500 feet in advance of the longwall face.

11. The system of claim 10, wherein the hydraulic support member is selected from the group consisting of a shield support, a chock support, a chock shield support, and a mobile roof support.

12. A method for supporting a tailgate entry for underground retreat longwall mining, the method comprising:

providing a longwall face of a mineral seam having a front abutment loading positioned in advance of the longwall face;

positioning a movable support apparatus within a tailgate entry of a longwall mine to form an access passage between opposing walls of the tailgate entry, the movable support apparatus positioned parallel to a longitudinal axis of a the tailgate entry to maximize airflow within the access passage, the movable support apparatus comprising:

a hydraulic support member comprising a head plate configured to selectively engage a mine roof, a foot plate configured to engage a mine floor and a hydraulic extension member configured to selectively engage the mine roof of a gate entry with the head plate and the mine floor of the gate entry with the foot plate;

a lateral extension member configured to extend and retract laterally to selectively engage a wall of the tailgate entry in response to a control signal to define a second access passage between the wall of the gate entry and the apparatus, the lateral extension member comprising a side plate and two or more hydraulic rams coupled to the side plate, the lateral extension member configured to maximize the size of the access passage to facilitate safe ingress and egress of personnel;

a controller in communication with the hydraulic support member, the controller configured to extend the hydraulic support member to engage the mine roof and mine floor and retract the hydraulic support member to disengage the mine roof and mine floor;

a vehicle connected to the support member and controller, the vehicle configured to move the hydraulic support member in response to a motive force acting on the vehicle, the vehicle positioned within the front abutment loading and wherein the support member, controller, and vehicle are independent of a mining face conveyor;

positioning support cabling and hoses for mining equipment within the access passage by way of hooks such that the cabling and hoses are protected from damage due to wall, floor, or roof failures and do not impede safe ingress and egress of personnel;

conducting retreat longwall mining operations such that the front abutment loading acting on the tailgate entry advances as the longwall face advances along the tailgate entry; and re-positioning the movable support apparatus within the tailgate entry in response to commands from the controller such that the access passage remains substantially unblocked during retreat longwall mining operations.

13. The method of claim 12, wherein positioning a movable support apparatus comprises positioning the movable support apparatus such that the movable support apparatus operates independent of a longwall face conveyor.

14. The method of claim 13, further comprising extending the lateral extension member to engage one or both walls of the gate entry in response to a control signal from the controller.

15. The method of claim 14, wherein positioning a movable support apparatus comprises positioning a plurality of movable support apparatuses within the tailgate entry.

16. The method of claim 12, wherein positioning a movable support apparatus comprises extending the hydraulic support member to engage the mine roof and mine floor to support a support capacity of between about 100 tons and about 2000 tons.

17. The method of claim 12, further comprising positioning one or more movable support apparatuses within the tailgate entry in advance of a longwall front abutment loading to account for known weak tailgate entry structural conditions.

* * * * *